US006464369B1

(12) United States Patent
Vega et al.

(10) Patent No.: US 6,464,369 B1
(45) Date of Patent: Oct. 15, 2002

(54) HELMET WITH SAFETY LIGHT

(76) Inventors: Mario C. Vega, 1736 Ohio Ave., Long Beach, CA (US) 90804; Thomas H. Ramirez, 1736 Ohio Ave., Long Beach, CA (US) 90804

( * ) Notice: Subject to any disclaimer, the term of this patent is extended or adjusted under 35 U.S.C. 154(b) by 0 days.

(21) Appl. No.: 09/671,905

(22) Filed: Sep. 28, 2000

(51) Int. Cl.[7] ..... F21V 21/084
(52) U.S. Cl. ..... 362/106; 362/105
(58) Field of Search ..... 362/105, 106, 362/164, 103, 394, 473; 439/660

(56) References Cited

U.S. PATENT DOCUMENTS

| | | | | |
|---|---|---|---|---|
| 2,473,394 A | | 6/1949 | Scott | |
| 3,577,561 A | | 5/1971 | Oshima | |
| 3,963,917 A | | 6/1976 | Romano | |
| 4,901,210 A | | 2/1990 | Hanabusa | |
| D310,434 S | | 9/1990 | Breece | |
| 5,327,588 A | * | 7/1994 | Gerneau | 2/422 |
| 5,329,637 A | * | 7/1994 | Walker | 2/5 |
| 5,416,675 A | | 5/1995 | De Beaux | |
| 5,508,900 A | * | 4/1996 | Norman | 362/106 |
| 5,688,039 A | * | 11/1997 | Johnson | 362/106 |
| 5,743,621 A | * | 4/1998 | Mantha et al. | 362/105 |
| 6,113,433 A | * | 9/2000 | Al-Turki | 439/639 |
| 6,244,721 B1 | * | 6/2001 | Rodriguez | 362/106 |

FOREIGN PATENT DOCUMENTS

DE 29922915 U1 * 4/2000

* cited by examiner

*Primary Examiner*—Sandra O'Shea
*Assistant Examiner*—Hargobind S. Sawhney

(57) ABSTRACT

A helmet with safety light for enhancing the visibility of a helmet. The helmet with safety light includes a helmet. The helmet is adapted for placement upon the head of user. The helmet generally comprises a peripheral wall. The peripheral wall has an inside surface and an outer surface. The outer surface has a channel therein. The peripheral wall has a bore therein, which is generally positioned in a front portion of the helmet. A light means for emitting a light is mounted to the helmet and positioned in the channel. A power supply is operationally coupled to the light means. The power supply is positioned in the bore in the peripheral wall. An actuating means for turning the light means on and off is operationally coupled to the light means.

1 Claim, 4 Drawing Sheets

HELMET WITH SAFETY LIGHT

BACKGROUND OF THE INVENTION

1. Field of the Invention

The present invention relates to helmet devices and more particularly pertains to a new helmet with safety light for enhancing the visibility of a helmet.

2. Description of the Prior Art

The use of helmet devices is known in the prior art. More specifically, helmet devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,963,917; U.S. Pat. No. 5,416,675; U.S. Pat. No. 3,577,561; U.S. Pat. No. 4,901,210; U.S. Pat. No. 2,473,394; and U.S. Des. Pat. No. 310,434.

While these devices fulfill their respective, particular objectives and requirements, the aforementioned patents do not disclose a new helmet with safety light. The inventive device includes a helmet. The helmet is adapted for placement upon the head of user. The helmet generally comprises a peripheral wall. The peripheral wall has an inside surface and an outer surface. The outer surface has a channel therein. The peripheral wall has a bore therein, which is generally positioned in a front portion of the helmet. A light means for emitting a light is mounted to the helmet and positioned in the channel. A power supply is operationally coupled to the light means. The power supply is positioned in the bore in the peripheral wall. An actuating means for turning the light means on and off is operationally coupled to the light means.

In these respects, the helmet with safety light according to the present invention substantially departs from the conventional concepts and designs of the prior art, and in so doing provides an apparatus primarily developed for the purpose of enhancing the visibility of a helmet.

SUMMARY OF THE INVENTION

In view of the foregoing disadvantages inherent in the known types of helmet devices now present in the prior art, the present invention provides a new helmet with safety light construction wherein the same can be utilized for enhancing the visibility of a helmet.

The general purpose of the present invention, which will be described subsequently in greater detail, is to provide a new helmet with safety light apparatus and method which has many of the advantages of the helmet devices mentioned heretofore and many novel features that result in a new helmet with safety light which is not anticipated, rendered obvious, suggested, or even implied by any of the prior art helmet devices, either alone or in any combination thereof.

To attain this, the present invention generally comprises a helmet. The helmet is adapted for placement upon the head of user. The helmet generally comprises a peripheral wall. The peripheral wall has an inside surface and an outer surface. The outer surface has a channel therein. The peripheral wall has a bore therein, which is generally positioned in a front portion of the helmet. A light means for emitting a light is mounted to the helmet and positioned in the channel. A power supply is operationally coupled to the light means. The power supply is positioned in the bore in the peripheral wall. An actuating means for turning the light means on and off is operationally coupled to the light means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine-quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new helmet with safety light apparatus and method which has many of the advantages of the helmet devices mentioned heretofore and many novel features that result in a new helmet with safety light which is not anticipated, rendered obvious, suggested, or even implied by any of the prior art helmet devices, either alone or in any combination thereof.

It is another object of the present invention to provide a new helmet with safety light which may be easily and efficiently manufactured and marketed.

It is a further object of the present invention to provide a new helmet with safety light which is of a durable and reliable construction.

An even further object of the present invention is to provide a new helmet with safety light which is susceptible of a low cost of manufacture with regard to both materials and labor, and which accordingly is then susceptible of low prices of sale to the consuming public, thereby making such helmet with safety light economically available to the buying public.

Still yet another object of the present invention is to provide a new helmet with safety light which provides in the apparatuses and methods of the prior art some of the advantages thereof, while simultaneously overcoming some of the disadvantages normally associated therewith.

Still another object of the present invention is to provide a new helmet with safety light for enhancing the visibility of a helmet.

Yet another object of the present invention is to provide a new helmet with safety light which includes a helmet. The helmet is adapted for placement upon the head of user. The helmet generally comprises a peripheral wall. The peripheral wall has an inside surface and an outer surface. The outer surface has a channel therein. The peripheral wall has a bore therein, which is generally positioned in a front portion of the helmet. A light means for emitting a light-is mounted to the helmet and positioned in the channel. A power supply is operationally coupled to the light means. The power supply is positioned in the bore in the peripheral wall. An actuating means for turning the light means on and off is operationally coupled to the light means.

Still yet another object of the present invention is to provide a new helmet with safety light that automatically turns on when a user places the helmet on their head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
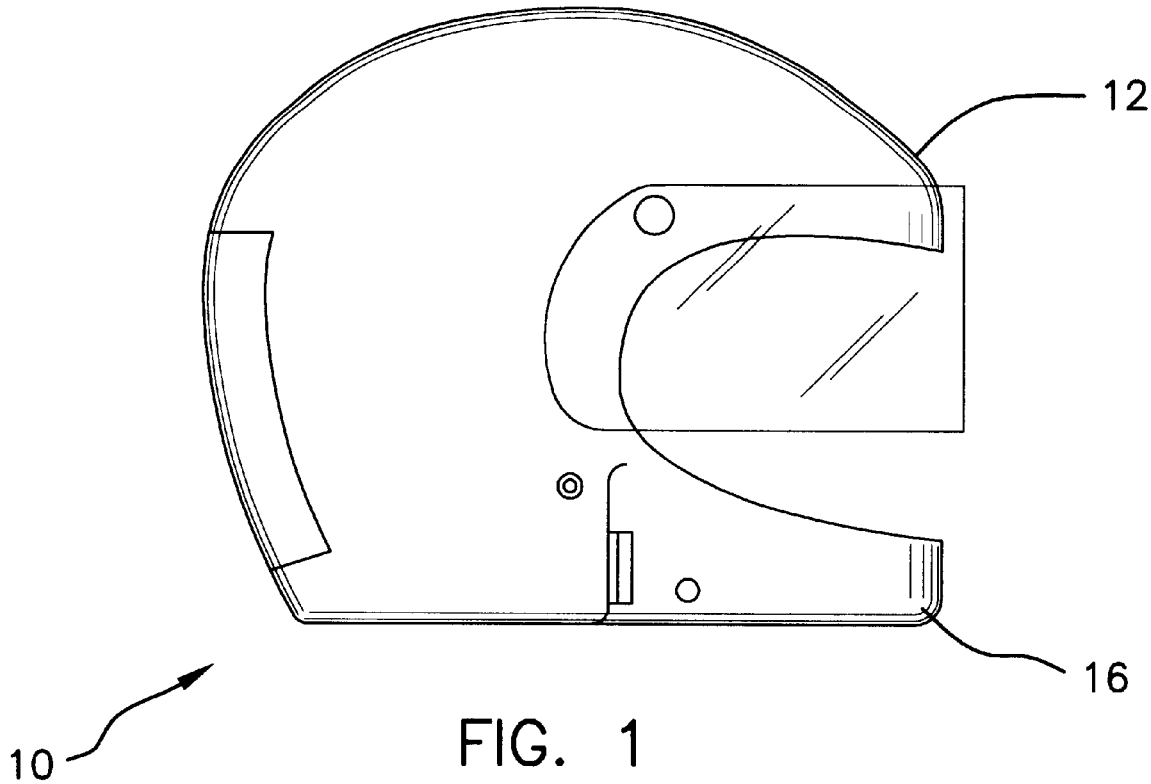
FIG. 1 is a schematic side view of a new helmet with safety light according to the present invention.
Figure 2:
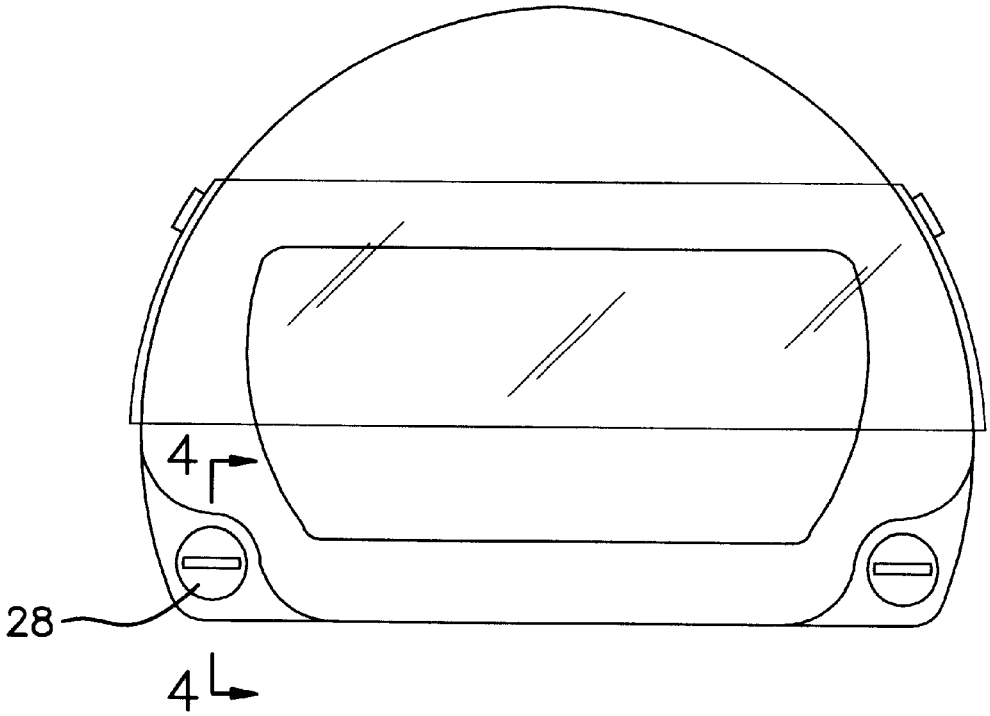
FIG. 2 is a schematic front view of the present invention.
Figure 3:
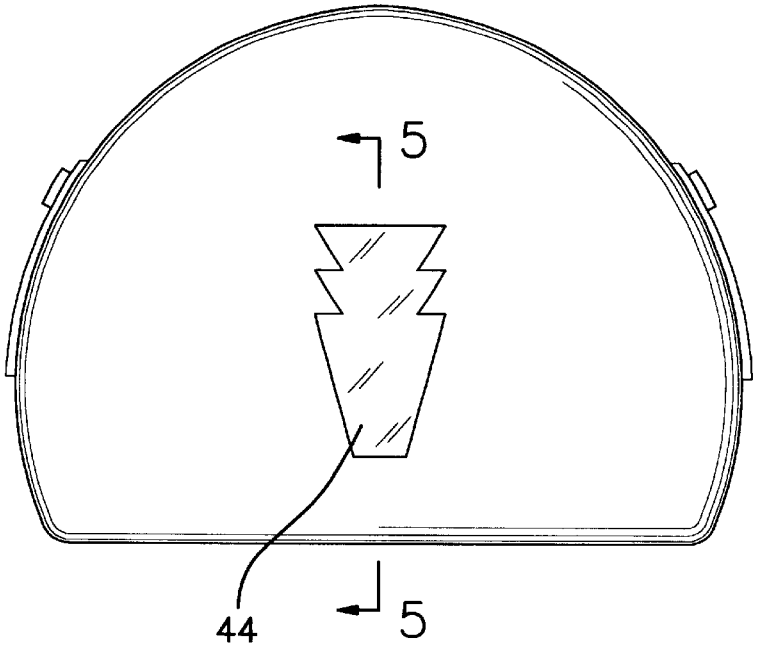
FIG. 3 is a schematic back view of the present invention.
Figure 5:
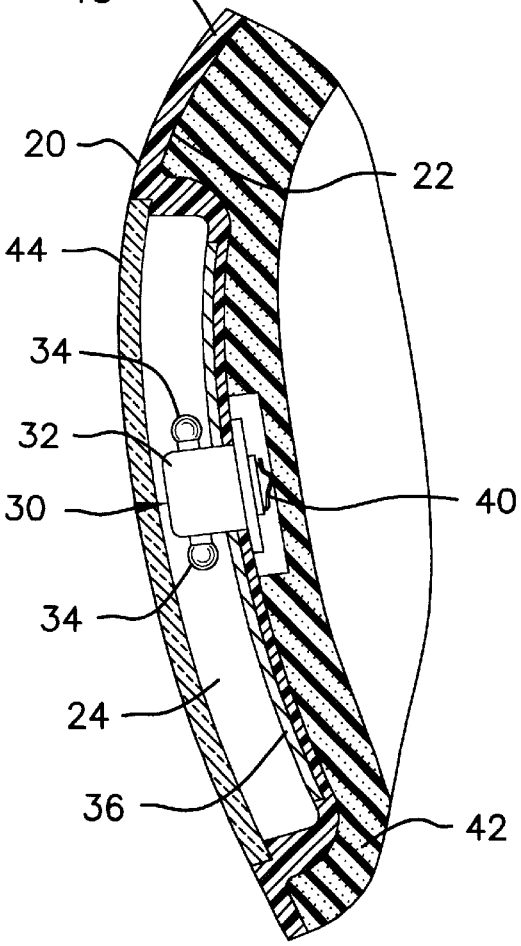
FIG. 5 is a schematic cross-sectional view taken along line 5—5 of the present invention.
Figure 4:
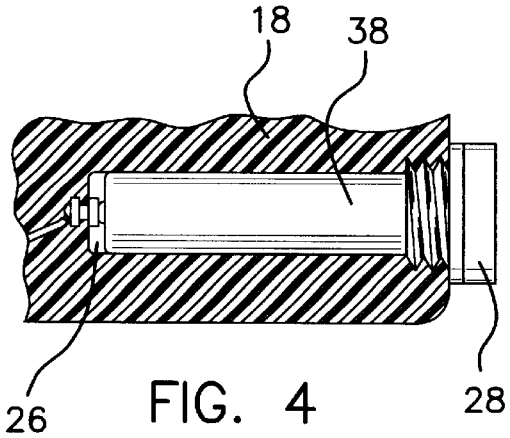
FIG. 4 is a schematic cross-sectional view taken along line 4—4 of the present invention.
Figure 6:
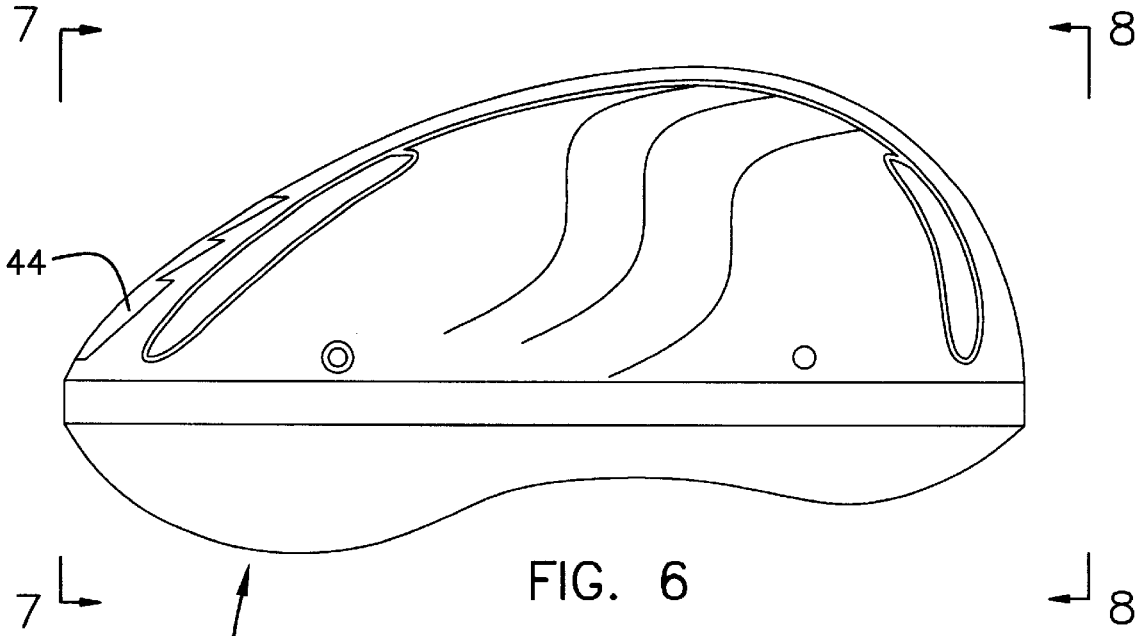
FIG. 6 is a schematic side view of the bicycle helmet of the present invention.

With reference now to the drawings, and in particular to FIGS. 1 through 6 thereof, a new helmet with safety light embodying the principles and concepts of the present invention and generally designated by the reference numeral 10 will be described.

Figure 7:
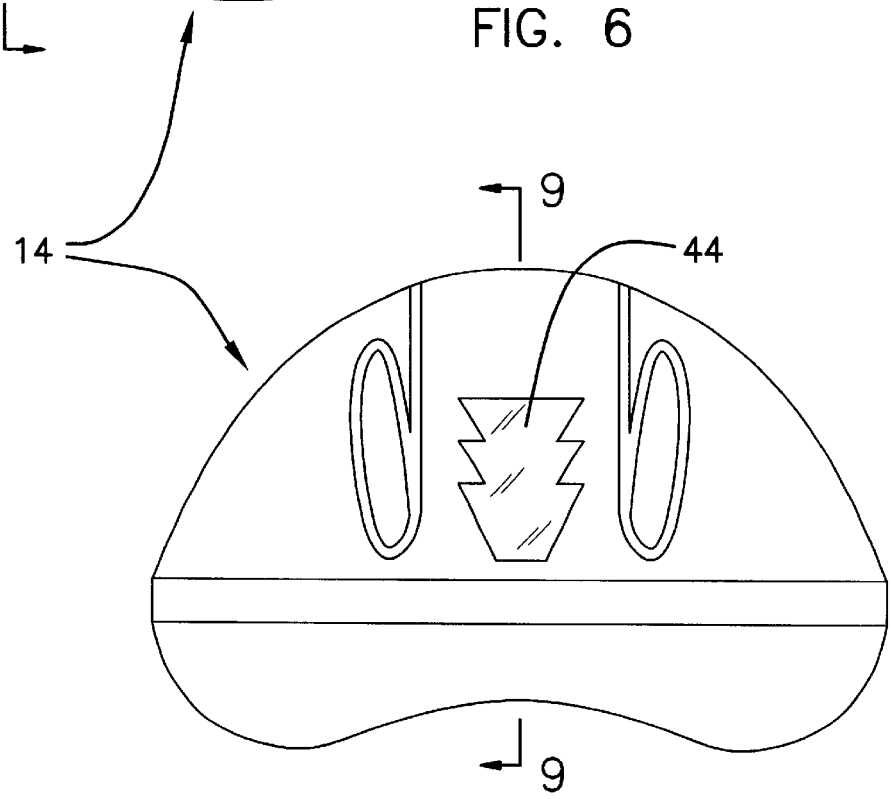
FIG. 7 is a schematic front view of the present invention.
Figure 8:
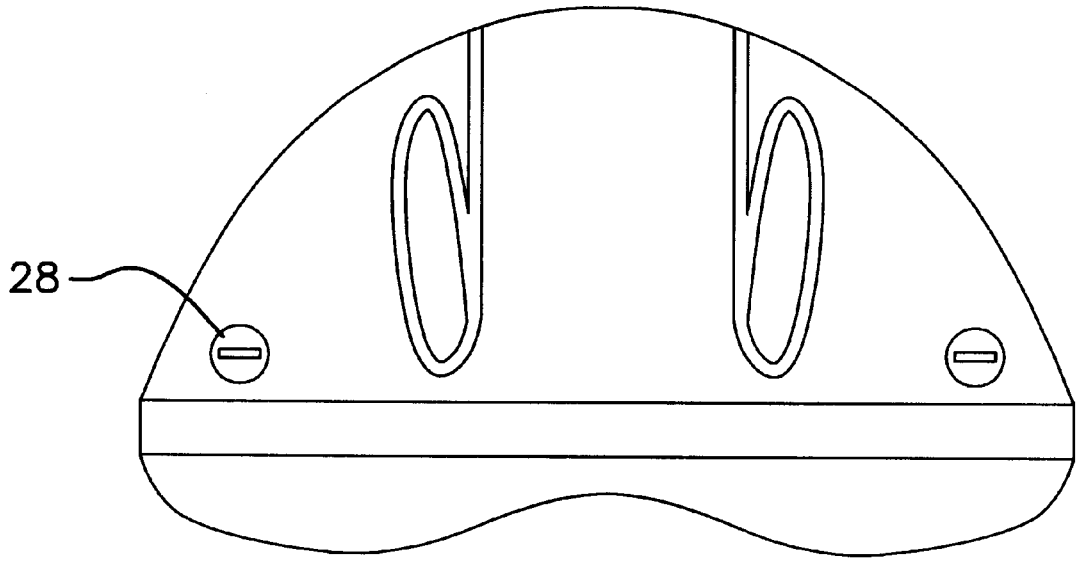
FIG. 8 is a schematic front view of the present invention.
Figure 9:
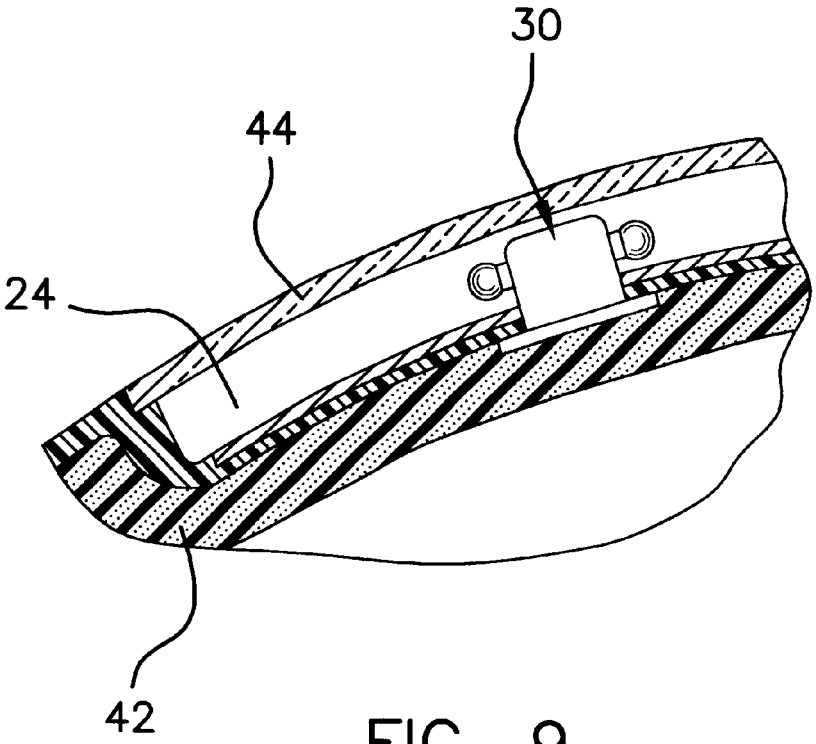
FIG. 9 is a schematic cross-sectional view taken along line 9—9 of the present invention.

As best illustrated in FIGS. 1 through 9, the helmet with safety light 10 generally comprises a helmet 12. The helmet 12 being a conventional helmet of the bicycle 14 and motorcycle 16 type. Motorcycle 16 type helmets are shown in FIGS. 1 through 5. Bicycle 14 helmets are depicted in FIGS. 6 through 9. The helmet 12 is adapted for placement upon the head of user. The helmet 12 generally comprises a peripheral wall 18. The peripheral wall 18 has an inside surface 20 and an outer surface 22. The outer surface 22 has a channel therein 24. The channel 24 is preferably positioned in a back side of the helmet 12. The channel 24 may have multiple shapes. The peripheral wall 18 has a bore 26 therein. The bore 26 is preferably positioned in a front portion of the helmet 12 and is ideally threaded.

A cap member 28 for selectively closing the bore 26 is threaded. The cap member 28 is adapted for being removably coupled to the threads in the bore 26.

A light means 30 for emitting a light is mounted to the helmet 12 and positioned in the channel 24. The light means 30 comprises a light socket 32 mounted in the channel. A pair of lights 34 is operationally coupled to the light socket 32.

A reflective material 36 is positioned in the channel such that the light may reflect outwardly away from the channel.

A power supply 38 is operationally coupled to the light means 30. The power supply 38 is positioned in the bore 26 in the peripheral wall 18. The power supply 38 preferably comprises a battery.

An actuating means 40 for turning the light means 30 on and off is mounted on the inside surface 22 of the peripheral wall 18 and is operationally coupled to the light means 30. The actuating means 40 comprises a pressure activated switch so that the light means 30 is turned on when a user places their head against the switch.

A padding membrane 42 is securely coupled to and generally covers the inside surface 22 of the peripheral wall 18. The actuating means 40 is positioned between the padding membrane 42 and the peripheral wall 18. The padding membrane 42 is conventional padding found in motorcycle and bicycle helmets.

A translucent covering 44 is securely attached to the peripheral wall 18 and covers the channel 24. The translucent covering is colored, preferably red. The translucent covering 44 is reflective and comprises conventional translucent coverings 44 found in car taillights.

In use, the helmet 12 is worn as a conventional helmet. When placed on the head of a user, the user's head presses against the actuating means 40 to-turn the light mean 30 on. The battery 38 is changed by removing the cap member 28 and removing the battery.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An illuminated safety helmet device, said device comprising:

a helmet for placement upon the head of user, said helmet generally comprising a peripheral wall, said peripheral wall having an inside surface and an outer surface, said outer surface having a channel therein, said channel being positioned in a back side of said helmet, said peripheral wall having a bore therein, said bore being generally positioned in a front portion of said helmet, said bore being threaded;

a cap member for selectively closing said bore, said cap member being threaded, said cap member couplable to said threads in said bore;

a light means for emitting a light being mounted to said helmet and positioned in said channel, said light means comprising a light socket mounted in said channel and a pair of lights operationally coupled to said light socket;

a power supply being operationally coupled to said light means, said power supply being positioned in said bore in said peripheral wall, said power supply comprising a battery;

an actuating means for turning said light means on and off being mounted on said inside surface of said peripheral wall and operationally coupled to said light means, said actuating means comprising a pressure activated switch;

a padding membrane being securely coupled to and generally covering said inside surface of said peripheral wall, wherein said actuating means is positioned between said padding membrane and said peripheral wall; and a translucent covering being securely attached to and covering said channel, said translucent covering being colored, said translucent covering being reflective.

* * * * *